US010979800B2

(12) United States Patent
Xiao et al.

(10) Patent No.: US 10,979,800 B2
(45) Date of Patent: Apr. 13, 2021

(54) SOUNDING DEVICE

(71) Applicant: AAC Technologies Pte. Ltd., Singapore (SG)

(72) Inventors: Bo Xiao, Shenzhen (CN); Xiaodong Liu, Shenzhen (CN); Ronglin Linghu, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 0 days.

(21) Appl. No.: 16/702,550

(22) Filed: Dec. 4, 2019

(65) Prior Publication Data

US 2020/0213718 A1 Jul. 2, 2020

(30) Foreign Application Priority Data

Dec. 28, 2018 (CN) ..... 201822239474.8

(51) Int. Cl.
*H04R 9/06* (2006.01)
*H04R 1/28* (2006.01)
*H04R 9/02* (2006.01)

(52) U.S. Cl.
CPC ..... *H04R 1/2834* (2013.01); *H04R 1/2811* (2013.01); *H04R 9/025* (2013.01); *H04R 9/06* (2013.01)

(58) Field of Classification Search
CPC combination set(s) only.
See application file for complete search history.

(56) References Cited

U.S. PATENT DOCUMENTS 9,238,252 B2 * 1/2016 Xu ..... B06B 1/04
10,141,825 B2 * 11/2018 Mao ..... H02K 33/16

FOREIGN PATENT DOCUMENTS

CN 206894886 B1 1/2018

OTHER PUBLICATIONS

PCT search report dated Feb. 3, 2020 by SIPO in related PCT Patent Application No. PCT/CN2019/113323 (9 Pages).

* cited by examiner

*Primary Examiner* — Amir H Etesam
(74) *Attorney, Agent, or Firm* — W&G Law Group LLP

(57) ABSTRACT

A sounding device includes a shell, a vibrating system and a driving unit. The vibrating system includes a vibrating diaphragm, a magnetic vibrating plate, and a transmission piece. The magnetic vibrating plate includes a fixing portion fixed on the shell and a body portion bent and extended from the fixing portion and arranged oppositely to the vibrating diaphragm. The driving unit includes a coil and a magnet portion fixed relatively to the shell. The coil winds on the body portion, and an orthographic projection of the magnet portion falls onto the body portion and is close to the transmission piece, the magnet portion and the body portion are arranged separately. At least two magnetic vibrating plates respectively drive different positions of the vibrating diaphragm, and the magnetic vibrating plates correspond to the driving units one by one.

14 Claims, 3 Drawing Sheets

SOUNDING DEVICE

TECHNICAL FIELD

The present disclosure relates to the field of electroacoustic device technologies, and more particularly, to a sounding device.

BACKGROUND

As an electroacoustic device that converts audio electrical signals into acoustical signals under the condition of no sound leakage, a sounding device is widely used in communication terminal equipment such as mobile phones, fixed phones, earphones and so on to output audios.

With the continuous development of mobile devices, the structure of the sounding device is constantly updated. In a common moving coil sounding device in which a voice coil drives a vibrating diaphragm to vibrate and generate sound, the voice coil is easy to be damaged due to vibration for a long time, thus affecting the sounding effect. Because the voice coil needs to be electrically connected with the external component, the voice coil vibration may affect the stability of the electrical connection, and uneven amplitudes in different regions of a vibrating diaphragm portion affect a tone quality effect of the sounding device.

Therefore, it is necessary to provide a new sounding device.

DETAILED DESCRIPTION

Figure 1:
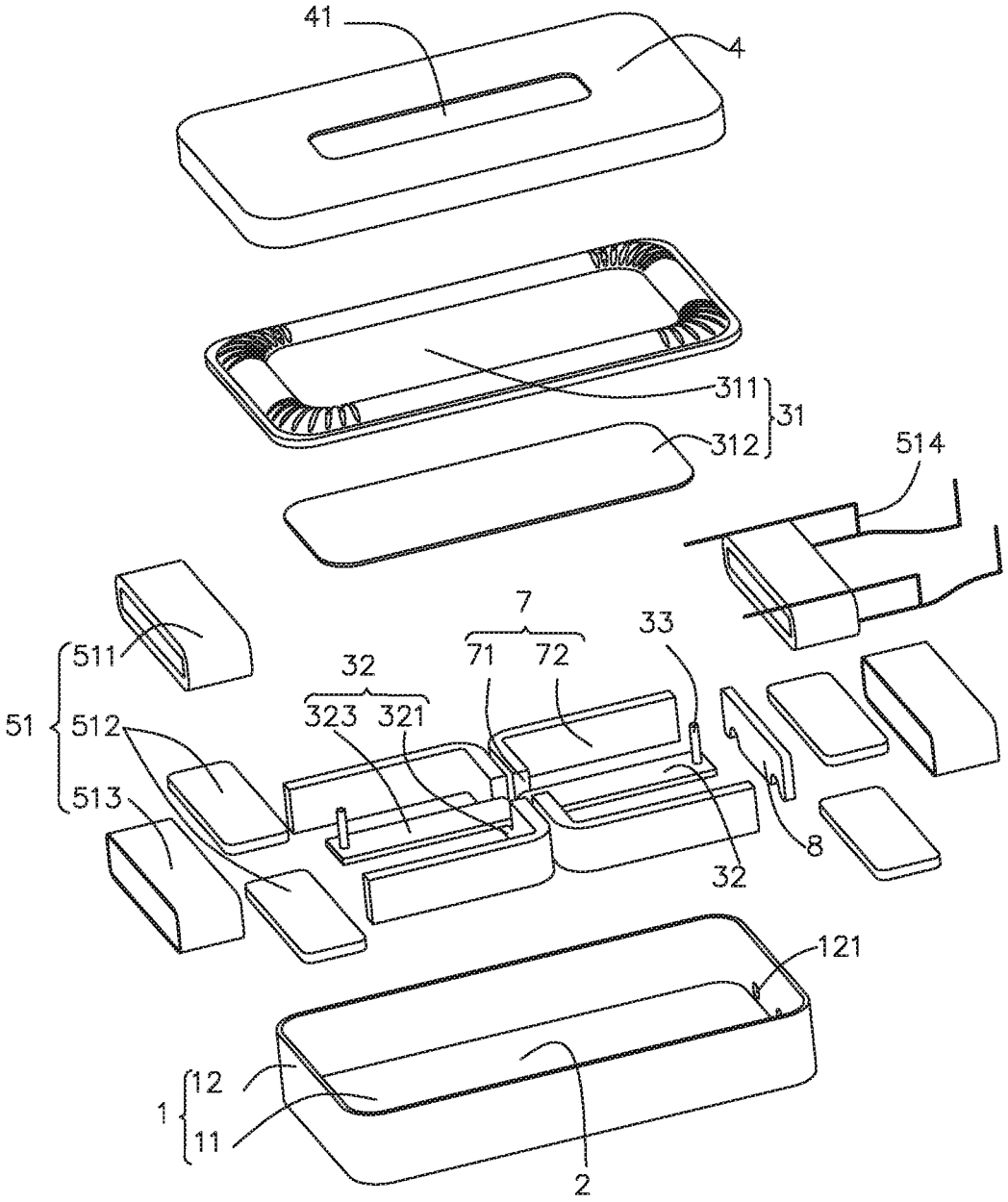
FIG. 1 is a 3D exploded view of a sounding device according to the present disclosure.
Figure 2:
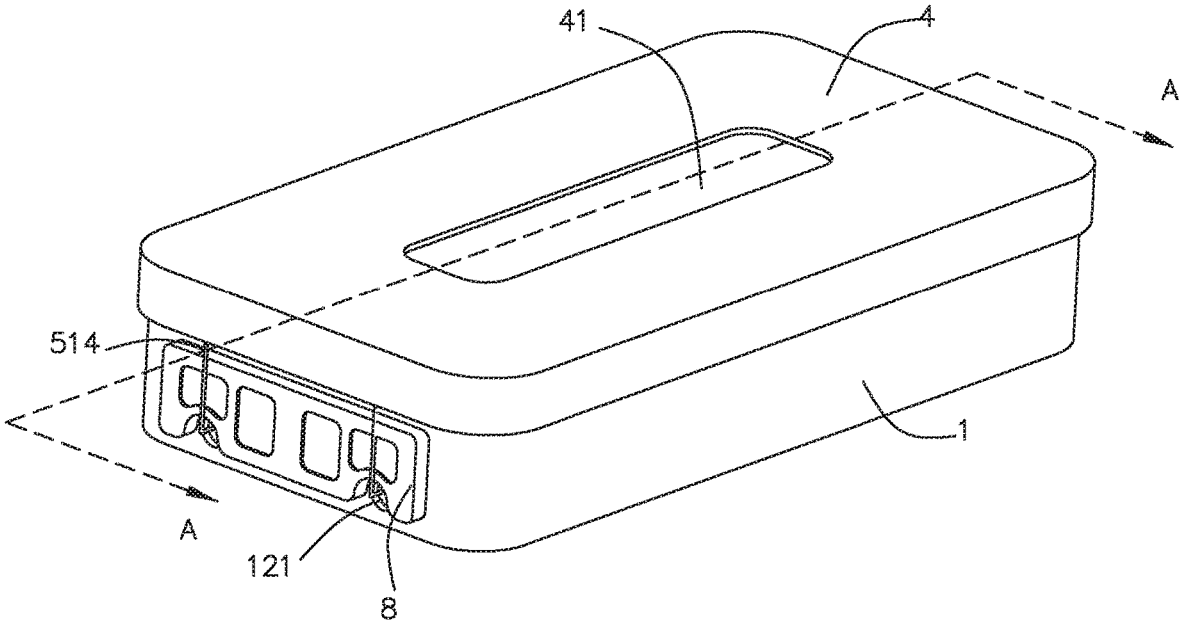
FIG. 2 is a schematic perspective view of the sounding device shown in FIG. 1.

In order to better understand the solutions of the present disclosure and advantages thereof in various aspects, the present disclosure will be described in further detail below with reference to the drawings through specific embodiments. In the following embodiments, a left-right direction in a principal plane of the drawing is taken as a horizontal direction, and an up-down direction in the principal plane of the drawing is taken as a vertical direction. In addition, the following specific embodiments are provided to facilitate a clearer and more thorough understanding of contents of the present disclosure, rather than to limit the present disclosure.

As shown in FIG. 1 and FIG, 2, the present disclosure provides a sounding device, which includes a shell 1 with an accommodating space 2, as well as a vibrating system 3 and a driving unit 4 accommodated in the accommodating space 2. The vibrating system 3 includes a vibrating diaphragm 31 fixed to the shell 1, a magnetic vibrating plate 32 for driving the vibrating diaphragm 31 to vibrate, and a transmission piece 33 connecting the vibrating diaphragm 31 with the magnetic vibrating plate 32. The magnetic vibrating plate 32 and the vibrating diaphragm 31 are arranged separately. The magnetic vibrating plate 32 includes a fixing portion 321 fixed to the shell 1 and a body portion 323 bent and extended from the fixing portion 321 and arranged oppositely to the vibrating diaphragm 31. The body portion 323 is suspended in the accommodating space 2, the transmission piece 33 is sandwiched between one end of the body portion 323 far away from the fixing portion 321 and the vibrating diaphragm 31, and the magnetic vibrating plate 32 pushes the vibrating diaphragm 31 to vibrate and generate sound through the transmission piece 33. Coils of at least two driving units 5 are connected in parallel. At least two magnetic vibrating plates 32 are provided, at least two magnetic vibrating plates 32 correspondingly push different parts of the vibrating diaphragm 31 to vibrate, and the magnetic vibrating plates 32 correspond to the driving units 5 one by one. Please refer to FIG. 1 and FIG. 4 for details.

Figure 3:
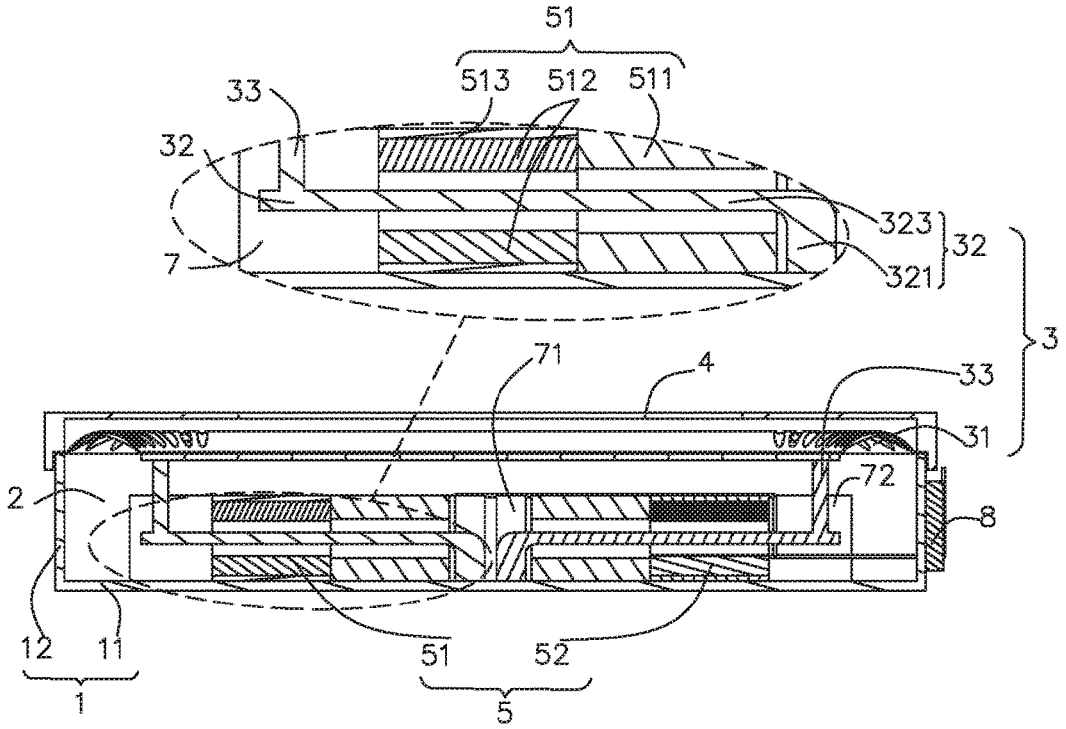
FIG. 3 is a sectional view of the sounding device shown in FIG. 1 along a line A-A.
Figure 4:
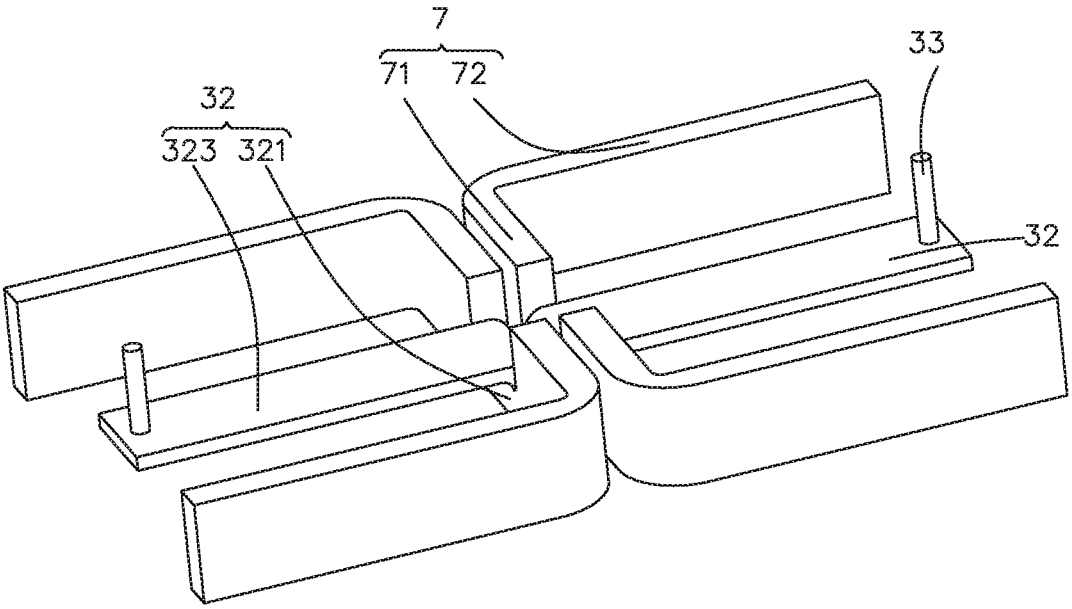
FIG. 4 is a schematic perspective view of a partial structure of the sounding device according to the present disclosure.
Figure 5:
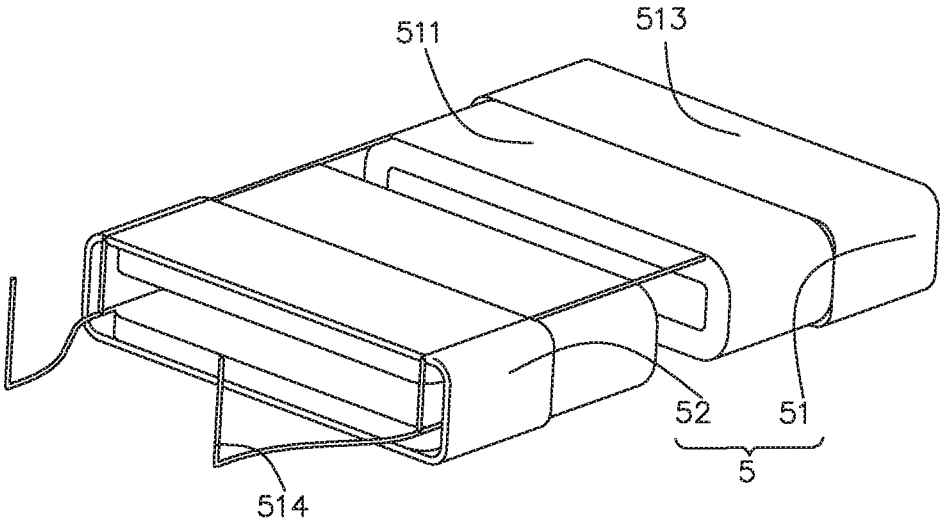
FIG. 5 is a schematic perspective view of a driving unit of the sounding device according to the present disclosure.

In the embodiment, as shown in FIG. 3, FIG. 4 and FIG. 5, two driving units 5 are provided. Specifically, a first driving unit 51 and a second driving unit 52 are symmetrically disposed in the accommodating space 2 and arranged oppositely to the vibrating diaphragm 31. Since the first driving unit 51 and the second driving unit 52 have the same structure, the first driving unit 51 is taken as an example for explanation and the second driving unit 52 will not be elaborated.

Preferably, the first driving unit 51 includes a coil 511 wound on the body portion 323 and fixed relatively to the shell 1, and a magnet portion 512 fixed relatively to the shell 1. An orthographic projection of the magnet portion 512 on the body portion 323 falls onto the body portion 323 and is close to the transmission piece 33. The magnet portion 512 and the body portion 323 are arranged separately. Each driving unit further includes a pole core 513 fixed in the shell 1. The pole core 513 is fixed with the magnet portion 512. The pole core 513 is annular, and the magnet portion 512 is fixed on an inner wall surface of the pole core 513. Please refer to FIG. 1 and FIG. 5 for details.

In the embodiment, the magnet portion 512 includes magnet pairs which are opposite and arranged separately and form a magnetic gap. The magnetic vibrating plate 32 is arranged between the magnet pairs and extends outside the magnet pairs through the magnetic gap. The pole core 513 is annular and wound around a periphery of the magnetic vibrating plate 32, and the magnet pairs are fixed to the pole core 513, and located between the magnetic vibrating plate 32 and the pole core 513. As shown in FIG. 3, the magnet pairs are arranged separately along a vibration direction of the magnetic vibrating plate 32, and have opposite polarities. The magnetic vibrating plate 32 is polarized under the action of the energized coil 511, and mutual attraction or repulsion occurs between the polarized magnetic vibrating plate 32 and the magnet portion 512, so that one end of the magnetic vibrating plate 32 far away from the fixing portion 321 reciprocates along the vibration direction, and drives the vibrating diaphragm 31 to vibrate and generate sound via the transmission piece 33.

The sounding device further includes a frame 7 fixed to the shell. The frame 7 includes a mounting wall 71 and extending walls 72 bent and extended from two opposite ends of the mounting wall 71 in the same direction, The magnetic vibrating plate 32 and the driving unit are mounted between the extending walls 72, and the fixing portion 321 of the magnetic vibrating plate 32 is fixed to the mounting wall 71. The frame 7, the magnetic vibrating plate 32, and the transmission piece 33 are integrally formed, and are not limited thereto. In other embodiments, the frame 7, the magnetic vibrating plate 32, and the transmission piece 33 may also be of separated structures, which need to be determined according to actual structural requirements specifically.

Further, the shell 1 includes a base wall 11 arranged oppositely to the vibrating diaphragm 31 and a side wall 12 bent from a periphery of the base wall 11 and extending towards the vibrating diaphragm 31. The mounting wall 71 is fixed to the base wall 11. The extending wall 12 is attached to the side wall 12, and is preferably parallel to the side wall 12. The coil 511 is fixed to the base wall 11 and limited between the two extending walls 72. The pole core 513 is fixed to the base wall 11 and limited between the two extending walls 72. The vibrating diaphragm 31 includes a body 311 fixed to the shell 1 and a stiffening plate 312 sandwiched between the body 311 and the transmission piece 33.

The sounding device further includes a circuit board 8 fixed on the side wall 12 and opposite to the mounting wall 71, and the circuit board 8 electrically connects the coil 511 with an external circuit. The circuit board 8 is fixed outside the accommodating space 2, the coil 511 is provided with a lead 514 extending outside the shell 1, the side wall 12 is provided with a through hole 121 corresponding to the lead 514, and the lead 514 extends outside the shell 1 via the through hole 121 and is electrically connected with the circuit board 8. In other embodiments of the present disclosure, the circuit board 8 may also be fixed on one side of the side wall 12 close to the accommodating space 2, and the present disclosure is not limited thereto.

Moreover, the sounding device further includes a cover plate 4 covered and connected to one side of the shell 1 close to the vibrating diaphragm 31, the body 311 is located between the shell 1 and the cover plate 4, and the cover plate 4 is provided with a sounding hole 4 penetrating through the cover plate. It should be noted that the above is for illustration only and cannot be understood as limiting the present disclosure.

In the present disclosure, the coil 511 is wound around the periphery of the magnetic vibrating plate 32 to form an electromagnet structure, the magnetic vibrating plate 32 is polarized, one end of the polarized magnetic vibrating plate 32 far away from the coil 511 interacts with the magnet portion 512 to push the vibrating diaphragm 31 to vibrate and generate sound through the transmission piece 33. Under the drive of the two driving units connected in parallel, driving force is increased, vibration amplitude is increased, product sensitivity is improved, and corresponding range is widened.

Compared with the related art, the sounding device according to the present disclosure can increase driving force, increase vibration amplitude, improve product sensitivity, and broaden corresponding range; and can increase driving stop points, improve vibration balance and improve product distortion.

It should be noted that those having ordinary skills in the art may make various modifications and changes without departing from the inventive concept of the present disclosure, and these modifications and changes shall all fall within the scope of protection of the present disclosure.

What is claimed is:

1. A sounding device, comprising a shell with an accommodating space, as well as a vibrating system and a driving unit accommodated in the accommodating space;

wherein the vibrating system comprises a vibrating diaphragm fixed to the shell, a magnetic vibrating plate driving the vibrating diaphragm to vibrate, and a transmission piece connecting the vibrating diaphragm with the magnetic vibrating plate;

the magnetic vibrating plate and the vibrating diaphragm are arranged separately;

the magnetic vibrating plate comprises a fixing portion fixed to the shell and a body portion bent and extended from the fixing portion and arranged oppositely to the vibrating diaphragm;

the body portion is suspended in the accommodating space, the transmission piece is sandwiched between one end of the body portion far away from the fixing portion and the vibrating diaphragm, and the magnetic vibrating plate pushes the vibrating diaphragm to vibrate and generate sound through the transmission piece;

and the driving unit comprises a coil wound on the body portion and fixed relatively to the shell, and a magnet portion fixed relatively to the shell;

an orthographic projection of the magnet portion on the body portion falls onto the body portion, the magnet portion and the body portion are arranged separately;

at least two magnetic vibrating plates respectively drive different parts of the vibrating diaphragm to vibrate correspondingly, and the magnetic vibrating plates correspond to the driving units one by one.

2. The sounding device according to claim I, wherein coils of at least two of the driving units are connected in parallel and symmetrically arranged to the vibrating diaphragm.

3. The sounding device according to claim I, wherein the driving unit further comprises a pole core fixed in the shell, and the pole core is fixed with the magnet portion.

4. The sounding device according to claim 3, wherein the magnet portion comprises magnet pairs Which are opposite and arranged separately and form a magnetic gap, the magnetic vibrating plate is arranged between the magnet pairs and extends outside the magnet pairs through the magnetic gap, the pole core is annular and wound around peripheries of the magnetic vibrating plate and the magnet pairs, and the magnet pairs are fixed to the pole core.

5. The sounding device according to claim 4, wherein the sounding device further comprises a frame fixed to the shell, the frame comprises a mounting wall and extending walls bent and extended from two opposite ends of the mounting wall in the same direction, the magnetic vibrating plate and the driving unit are mounted between the extending walls, and the fixing portion is fixed to the mounting wall.

6. The sounding device according to claim 5, wherein the shell comprises a base wall arranged oppositely to the vibrating diaphragm and a side wall bent from a periphery of the base wall and extending towards the direction of the vibrating diaphragm, the mounting wall is fixed to the base wall, and the extending wall is attached to the side wall.

7. The sounding device according to claim 6, wherein the coil is fixed to the base wall and limited between the two extending walls.

8. The sounding device according to claim 6, wherein the pole core is fixed to the base wall and limited between the two extending walls.

9. The sounding device according to claim 6, wherein the sounding device further comprises a circuit board fixed on the side wall and opposite to the mounting wall, and the circuit board electrically connects the coil with an external circuit.

10. The sounding device according to claim 9, wherein the circuit board is fixed outside the accommodating space, the coil is provided with a lead extending outside the shell, the side wall is provided with a through hole corresponding to the lead, and the lead extends outside the shell via the through hole and is electrically connected with the circuit board.

11. The sounding device according to claim 1, wherein the vibrating diaphragm comprises a body fixed to the shell and a stiffening plate sandwiched between the body and the transmission piece.

12. The sounding device according to claim 11, wherein the sounding device further comprises a cover plate covered and connected to one side of the shell close to the vibrating diaphragm, the body is located between the shell and the cover plate, and the cover plate is provided with a sounding hole penetrating through the cover plate.

13. The sounding device according to claim 5, wherein the frame, the magnetic vibrating plate and the transmission piece are integrally formed.

14. The sounding device according to claim 1, wherein the magnet portion is located between the transmission piece and the coil.

* * * * *